US006077104A

United States Patent [19]

Chang et al.

[11] Patent Number: 6,077,104

[45] Date of Patent: Jun. 20, 2000

[54] ELECTRICAL CONNECTOR HAVING DETECTION MEANS

[75] Inventors: Yao-Hao Chang, Chung-Ho; Chang-Xiu Du, Shi-An; Qi-sheng Zheng, Kun-Shan, all of Taiwan

[73] Assignee: Hon Hai Precision Ind. Co., Ltd., Taipei Hsien, Taiwan

[21] Appl. No.: 09/100,205

[22] Filed: Jun. 19, 1998

Related U.S. Application Data

[63] Continuation-in-part of application No. 08/879,622, Jun. 20, 1997, Pat. No. 5,888,092.

[30] Foreign Application Priority Data

Jun. 20, 1997 [TW] Taiwan ..... 85209379

[51] Int. Cl.[7] ..... H01R 3/00

[52] U.S. Cl. ..... 439/489; 439/188

[58] Field of Search ..... 439/188, 488, 439/489, 490, 607

[56] References Cited

U.S. PATENT DOCUMENTS

| | | | |
|---|---|---|---|
| 5,647,754 | 7/1997 | Kohno | 439/489 X |
| 5,651,693 | 7/1997 | Fukuda et al. | 439/188 X |
| 5,672,073 | 9/1997 | Matsumura et al. | 439/489 |

*Primary Examiner*—Khiem Nguyen

[57] ABSTRACT

An electrical connector comprises an insulating housing having a mating body and a plurality of passageways defined in the mating body; a plurality of conductive contacts received in the plurality of passageways; and detection means received in the mating body for detecting engagement of an external mating connector. The detection means comprises a first and a second plate juxtaposed together, each including a main body and a contact leg extending from said main body for engagement with a conductive contact of a mating electrical connector.

19 Claims, 5 Drawing Sheets

ELECTRICAL CONNECTOR HAVING DETECTION MEANS

This application is a continuation-in-part of application Ser. No. 08/879,622 filed Jun. 20, 1997, now U.S. Pat. No. 5,888,092.

BACKGROUND OF THE INVENTION

1. Field of The Invention

The invention relates to an electrical connector having detection means and detection means for such an electrical connector.

2. The Prior Art

With the prevailing of the computer network systems, more and more attentions are cast onto the reliability of network systems and a series of electrical connection testings will be performed before normal .use of the network systems. In conventional network systems, electrical connection testings are performed after all the mechanical connections of the systems are carried out. Since a network system may involve many peripherals, once a malfunction is found after the mechanical connections are completed, the system builder has to sequentially inspect each of the mechanical connections between the network system and the peripherals to locate the error causing the malfunction. This trouble-shooting process is very tedious and time-consuming. Several detection means were proposed in JP 61-169974 JP 1-167971, and JP 8-22873; the above-mentioned problems, however, were not satisfactorily solved. Hence, there is a need for an electrical connector having detection means for real-timely detecting the electrical connection between a network system and a peripheral to overcome the above-mentioned problems.

SUMMARY OF THE INVENTION

Accordingly, a main object of the present invention is to provide an electrical connector having detection means for real-timely detecting the electrical connection between a network system and a peripheral.

Another object of the present invention is to provide an electrical connector having detection means for detecting the electrical connection between the apparatus connected together.

To fulfill the above-mentioned objects, according to one embodiment of the present invention, an electrical connector comprises an insulating housing including a mating body and a plurality of passageways defined in the mating body; a plurality of conductive contacts received in the plurality of passageways; and detection means received in the mating body for detecting engagement of an external mating connector, wherein the detection means comprises a first plate and a second plate juxtaposed together, each of the first and second plates including a main body and a contact leg extending from the main body for engagement with a conductive contact of a mating electrical connector.

In another preferred embodiment, the present invention comprises detection means for an electrical connector. The detection means comprises a first plate and a second plate juxtaposed together, each of the first and second plates including a main body and a contact leg extending from the main body for engagement with a conductive contact of a mating electrical connector.

In still another preferred embodiment, the present invention comprises an arrangement of detection means in an insulating housing for an electrical connector. The housing comprises a plurality of passageways and a slot near a pair of the passageways and communicating with the pair of passageways; a conductive contact received in each of the pair of passageways; detection means received in the slot for detecting engagement of an external mating connector, wherein the detection means comprises a first plate and a second plate juxtaposed together, each of the first and second plates including a main body and a contact leg extending from the main body for engagement with a conductive contact of the mating electrical connector.

DETAILED DESCRIPTION OF THE PREFERRED EMBODIMENTS

Figure 1:
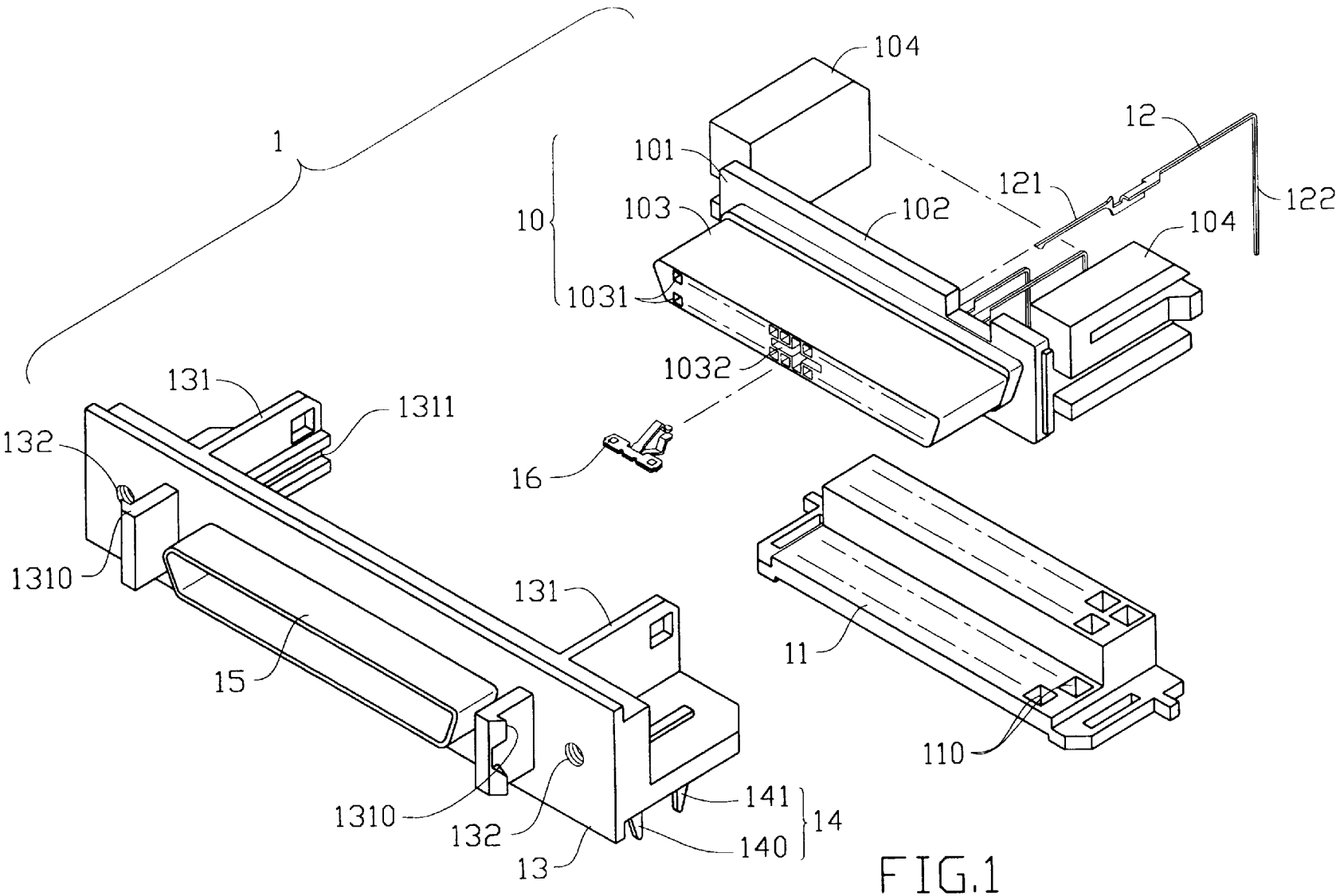
FIG. 1 shows an exploded perspective view of an electrical connector having detection means according to one preferred embodiment of the present invention.

Reference will now be made in detail to the preferred embodiments of the present invention. It will be noted here that for a better understanding, most of like components are designated by like reference numerals throughout the various figures in the embodiments.

Referring now to FIG. 1, an electrical connector having detection means according to the present invention is generally designated at 1. The electrical connector 1 mainly comprises an insulating housing 10, an insulating plate 11, a plurality of conductive contacts 12, a metal bracket 13, boardlocks 14, shielding means 15 and detection means 16.

The insulating housing 10 comprises a front mating surface 101, a rear mounting surface 102 opposed the mating surface 101, and a mating body 103 extending forward from the mating surface 101. An upper and a lower row of passageways 1031 (only a few being shown) are defined in the mating body 103 for receiving a portion of the contacts 12.

A horizontal slot 1032 is provided in the mating body 103 between the upper and lower rows of passageways 1031 and communicating with one upper and one lower passageway 1031 as means for positioning the detection means 16. In one preferred embodiment, the upper and lower passageways 1031 align with each other and a pair of aligned upper and lower passageways 1031 communicate with the horizontal slot 1032, forming a cross opening on the front surface of the mating body 103.

A pair of insulating blocks 104 extends rearward form both ends of the rear mounting surface 102 of the insulating housing 10 for isolating the contacts 12 on either side from the metal bracket 13 and for fixing the insulating housing 12 to the metal bracket 13.

The insulating plate 11, configured to cooperate with the insulating blocks 104, is provided at the rear side of the insulating housing 10. In one preferred embodiment, the insulating plate 11 is customized to have an upper and a lower step, each including a plurality of vertical apertures 110 for extending therethrough of the contacts 12. As can be seen, in the present embodiment, the horizontal contacts 12 (only one contact being shown) are bent 90 degrees to be vertically downward at their rear portions 122 for passing through the apertures 110 of the insulating plate 11.

The metal bracket 13 is substantially an elongate plate defining a central opening (not shown) for passing through of the mating body 103. The metal bracket 13 further comprises a pair of supports 131 extending rearward of both sides thereof for connecting to the pair of insulating blocks 104. Each of the support 131 includes a vertical plate (not labeled) a distance away from an end of the metal bracket 13 and a horizontal plate (not labeled) extending outward from a lower portion of the vertical plate.

The vertical plate defines a horizontal inward facing guide slot 1311 for guiding an outward facing guide bar (not labeled) on the insulating block 104 and a locking opening (not labeled) above the guide slot 1311 for locking an outward protrusion (not labeled) on the insulating blocks 104 above the guide bar. The horizontal plate comprises the boardlock 14 having a pair of legs 140, 141 for fixing onto a circuit board.

The metal bracket 13 further comprises a pair of hooks 1310 extending forward near both sides thereof for connecting to a mating connector (not shown) and a pair of screw holes 132 on both end portions thereof for further firmly securing the mating connector to the present connector 1.

The shielding means 15 is a metal shell provided on a front surface of the metal bracket 13 surrounding the central opening of the metal bracket 13.

Figure 3:
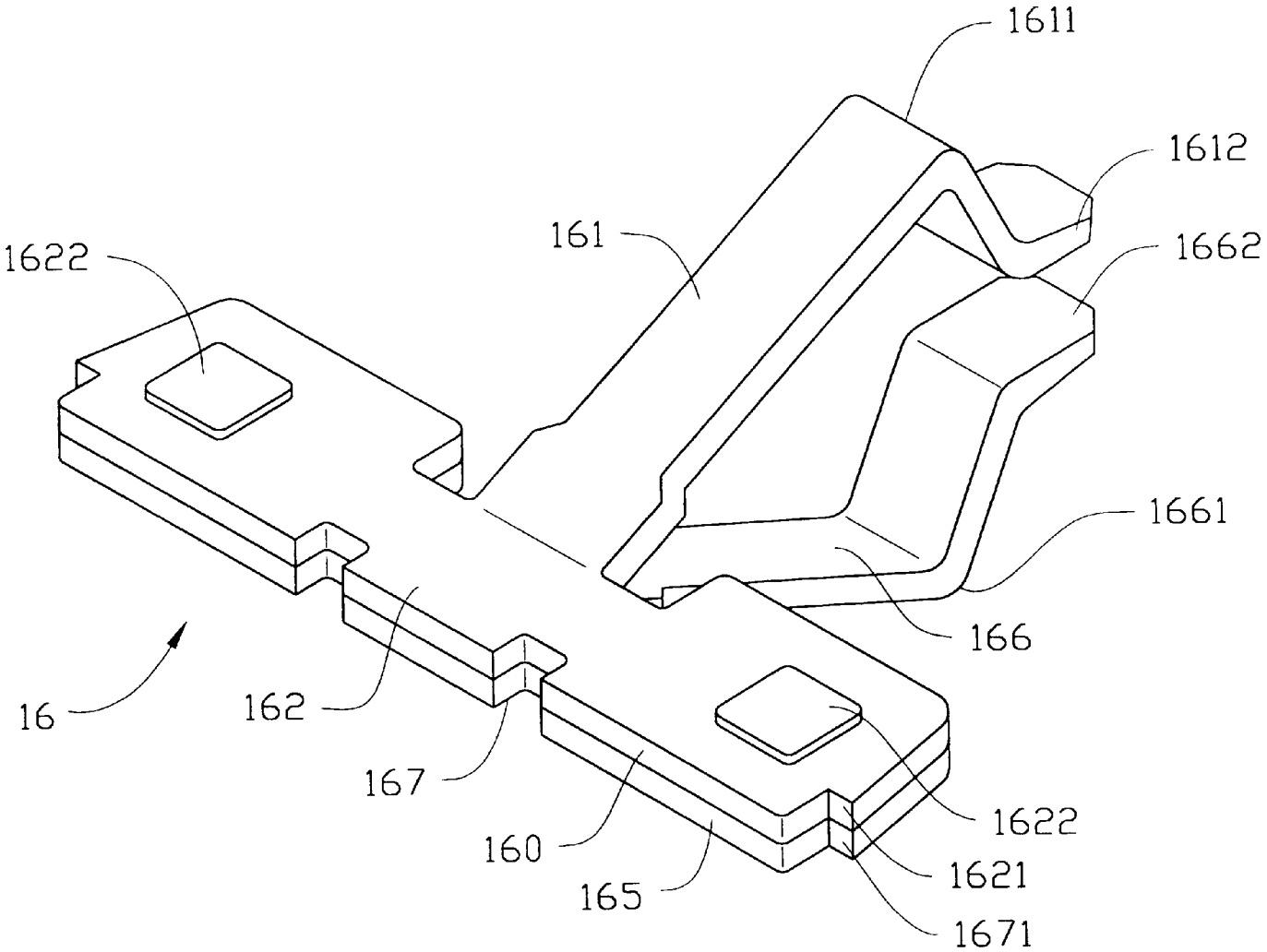
FIG. 3 shows a perspective view of detection means according to one preferred embodiment of the present invention.

Please now further refer to FIG. 3. The present detection means 16 comprises a first upper plate 160 and a second lower plate 165, and both of the plates 160, 165 are formed by stamping. The upper plate 160 includes a main plate 162 of a substantially rectangular shape and a first contact leg 161 extending rearward from a central rear edge thereof. The first leg 161 bends rearward and upward to a convex portion 1611, and then continuously bends twice in opposite directions to form a V-shaped end having an end stopper 1612. The main body 162 further comprises a plurality of barbs 1621 on its lateral edges and a pair of embossments 1622 on its surface.

Similarly, the lower plate 165 includes a main body 167 and a second contact leg 166 extending rearward from a central rear edge thereof. The second leg 166 bends rearward and downward to a convex portion 1661, and then continuously bends twice in opposite directions to form a V-shaped end having an end stopper 1662. Also, the main body 167 comprises barbs 1671 on its lateral edges and embossments 1622 (not shown) on its surface.

Figure 2:
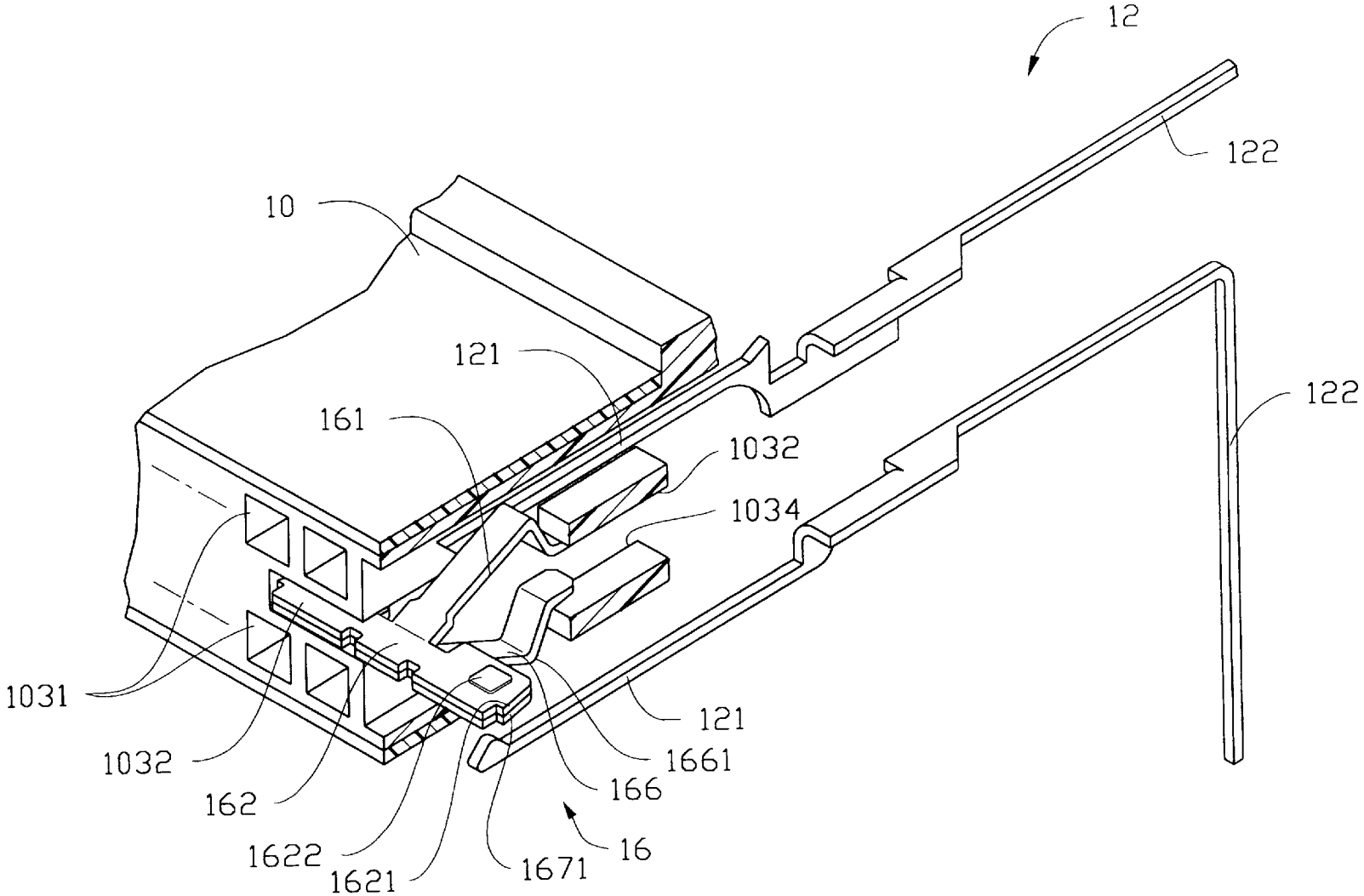
FIG. 2 shows a partially cut-away fragmentary perspective view of an electrical connector having detection means according to the present invention.
Figure 4:
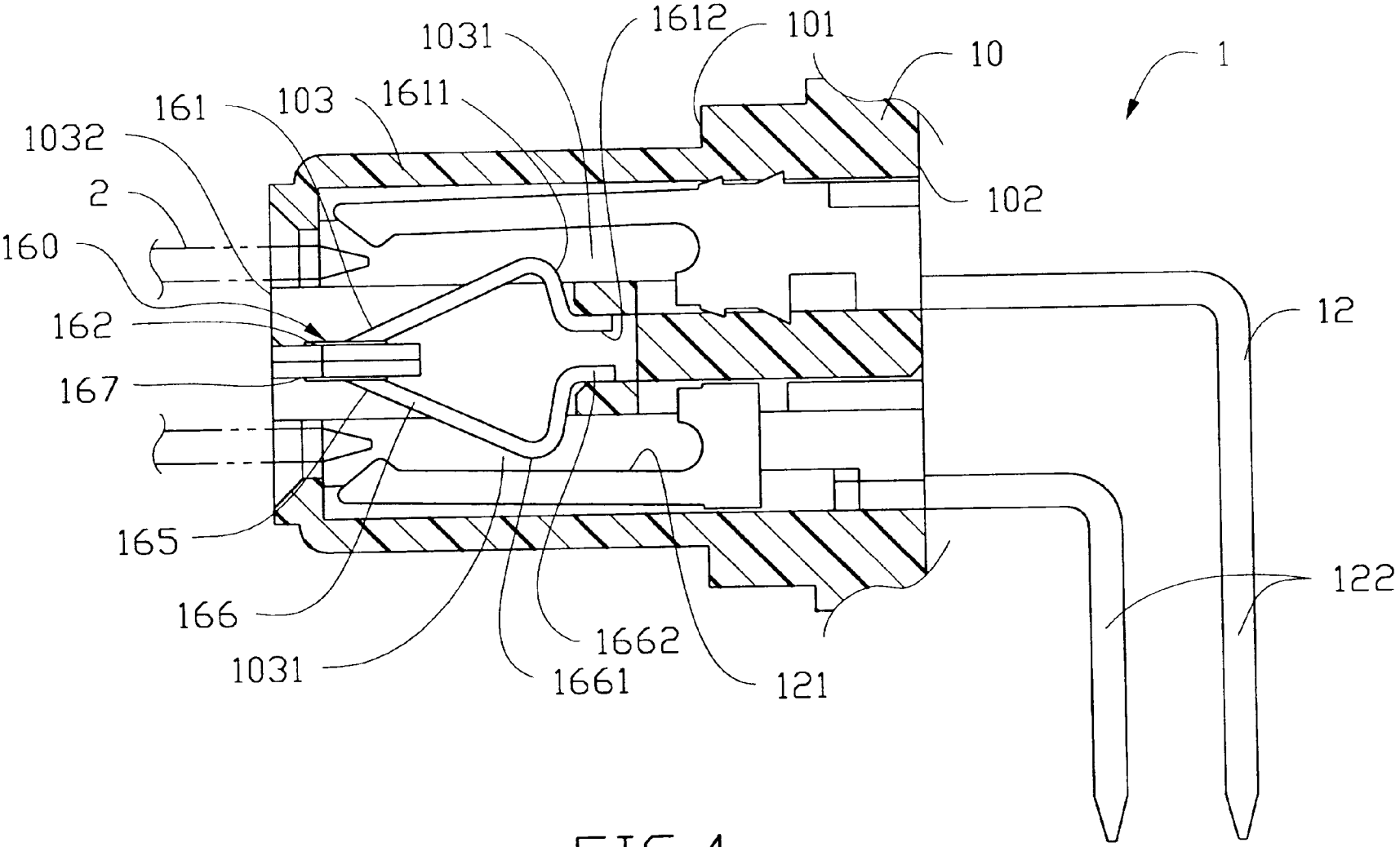
FIG. 4 shows a lateral cross-sectional view of detection means received in a housing for an electrical connector.

Referring to FIGS. 2 and 4, when positioning the detection means 16 into the horizontal slot 1032 of the mating body 103, the upper and lower plates 160, 165 are first juxtaposed so that the main bodies 162 and 167 overlap each other with the pair of legs 161, 166 extending rearward and the convex portions 1611, 1661 projecting out of the plane on which the main bodies 162, 167 locate.

Next, the assembled detection means 16 is inserted into the horizontal slot 1032 with the lateral barbs 1621, 1671 interferingly fitting into the side walls of the horizontal slot 1032 and the embossments 1622 urging on the upper and lower surfaces of the horizontal slot 1032 to firmly securing in the mating body 103. Thus, the first and second contact legs 161, 166 extend into the horizontal slot 1032 and the end stoppers 1612, 1662 of the first and second legs 161, 166 abut against an upper and a lower shoulder 1033, 1034 formed on inner walls of the horizontal slot 1032, respectively. The outermost convex portions 1611, 1661 of the upper and the lower contact legs 161, 166 project out of the horizontal slot 1032 into the upper and the lower passageways 1031 for engaging mating contacts of a mating connector (not shown).

Figure 5:
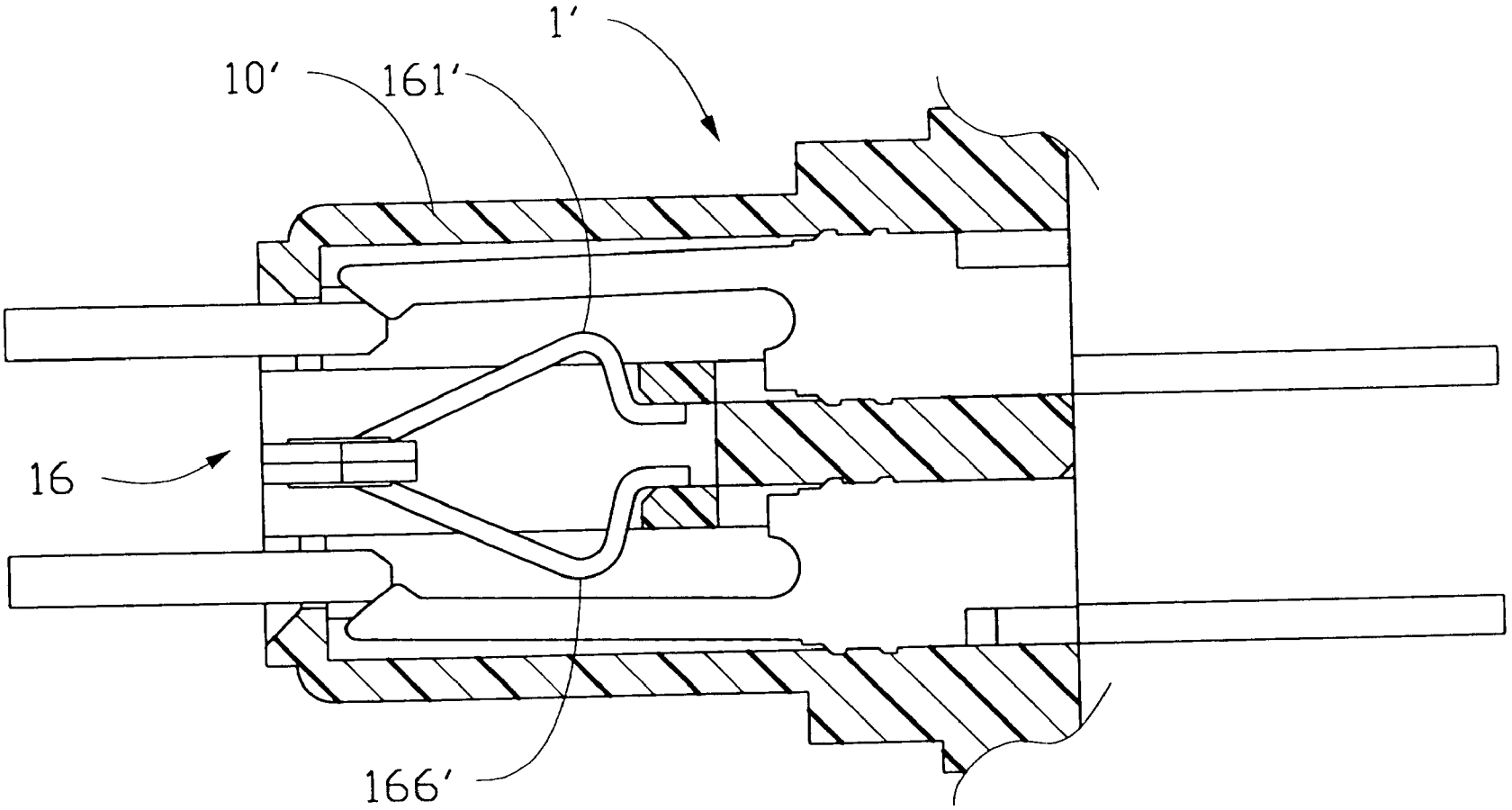
FIG. 5 shows a lateral cross-sectional view of detection means received in another housing for a vertical type electrical connector arrangement.

In one preferred embodiment, the first and second contact legs 161', 166' are the same, as shown in FIG. 5, which is the most economic way to manufacture the detection means 16. In another preferred embodiment, the first and the second contact legs 161, 166 are similar to but slightly different from each other in shape to provide different functions when mating with mating contacts. One example of this can be seen in FIG. 4, in which a front portion of the first contact leg 161 connecting the main body 162 may have a different slope from that of the second contact leg 166 so that when a mating connector is inserted into the present connector 1, one of the two contact legs 161, 166 will be engaged first with a mating contact 2 (shown in phantom lines) of the mating connector for grounding to reduce noise then, the other one of the contacts legs 161, 166 will be engaged with another mating contact 2 (shown in phantom lines) of the mating connector for transmitting an electrical signal to a circuit (not shown) for detecting whether the peripheral connected to the network system is in an on-line state and for reporting to a main circuit for reflecting the state to the system builder.

Since the contact legs 161, 166 are resilient, they will bend inward when pressed by the mating contacts, and return to their original position while the mating connector is removed.

FIG. 5 shows another embodiment of the present invention, wherein the detection means 16 is received in a housing 10' for a vertical type electrical connector arrangement 1'. It can be seen that the detection means 16 and its arrangement to the housing 10' are completely the same as those in the housing 10 of the connector 1. The differences between the connectors 1 and 1' are the portions of the housing 10 and 10' which do not influence the structural relation between the detection means 16 and the housing 10 or 10'.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An electrical connector, comprising an insulating housing including a mating body and a plurality of passageways defined in the mating body;

a plurality of conductive contacts received in said plurality of passageways; and detection means received in the mating body for detecting engagement of an external mating connector, wherein said detection means comprises a first plate and a second plate juxtaposed together, each of said first and second plates including a main body and a contact leg extending from said main body for engagement with a conductive contact of a mating electrical connector.

2. The electrical connector as claimed in claim 1, wherein said contact legs extend rearward and outwardly from said main bodies opposite to each other to form a V-shaped resilient structure.

3. The electrical connector as claimed in claim 1, wherein each of said contact legs comprises a outward convex portion bulging into the passageway for engaging a conductive contact of a mating connector.

4. The electrical connector as claimed in claim 1, wherein at least one of said contact legs includes a V-shaped end having an end stopper.

5. The electrical connector as claimed in claim 1, wherein one of said contact legs is used for coupling to an external circuit.

6. The electrical connector as claimed in claim 1, wherein one of said contact legs is used for grounding while engaging an conductive contact of a mating electrical connector.

7. The electrical connector as claimed in claim 1, wherein said first and second contact legs are so configured that one of said contact legs will engage first with a mating conductive contact and the other of said contact legs will then engage with another mating conductive contact while a mating electrical connector being inserted into said electrical connector.

8. The electrical connector as claimed in claim 1, wherein said detection means comprises positioning means for positioning said housing.

9. The electrical connector as claimed in claim 1, wherein said first and second plates are the same.

10. The electrical connector as claimed in claim 1, wherein at least one of said first and second plates is formed by stamping and bending.

11. A detection means for an electrical connector, comprising a first plate and a second plate juxtaposed together, each of said first and second plates including a main body and a contact leg extending from said main body for engagement with a conductive contact of a mating electrical connector; wherein said contact legs respectively extend rearward and outwardly from said main bodies opposite to each other to form a pair of V-shaped resilient structures.

12. The detection means for the electrical connector as claimed in claim 11, further comprising an outward convex portion on each of said contact legs.

13. The detection means for the electrical connector as claimed in claim 11, further comprising positioning means for positioning in a housing of the electrical connector.

14. An arrangement of detection means in an insulating housing for an electrical connector, said housing comprising a plurality of passageways and a slot near a pair of said passageways and communicating with said pair of passageways;

a conductive contact received in each of said pair of passageways;

detection means received in said slot for detecting engagement of an external mating connector, wherein said detection means comprises a first plate and a second plate juxtaposed together, each of said first and second plates including a main body and a contact leg extending from said main body for engagement with a conductive contact of the mating electrical connector.

15. The arrangement of detection means in the insulating housing for the electrical connector as claimed in claim 14, wherein each of said contact legs comprises an outward convex portion bulging into the passageway for engaging a conductive contact of the mating connector.

16. The arrangement of detection means in the insulating housing for the electrical connector as claimed in claim 15, wherein each of said contact legs further comprises a V-shaped end portion successively extending from the convex portion and having an end stopper abutting against a shoulder formed on an inner wall of said slot.

17. The arrangement of detection means in the insulating housing for the electrical connector as claimed in claim 14, wherein said first and second plates are so configured that one of said contact legs engages with a mating conductive contact before the other while a pair of mating conductive contacts being inserted into said pair of passageways.

18. A detection means for an electrical connector, comprising a first plate and a second plate juxtaposed together, each of said first and second plates including a main body and a contact leg extending from said main body for engagement with a conductive contact of a mating electrical connector, a V-shaped end portion with an end stopper on each of said contact legs.

19. A detection means for an electrical connector, comprising a first plate and a second plate juxtaposed together, each of said first and second plates including a main body and a contact leg extending from said main body for engagement with a conductive contact of a mating electrical connector; wherein said first and second plates are same with each other.

* * * * *